US012059057B2

(12) United States Patent
Kohatsu et al.

(10) Patent No.: US 12,059,057 B2
(45) Date of Patent: Aug. 13, 2024

(54) SECURING MECHANISMS FOR ARTICLES OF FOOTWEAR

(71) Applicant: NIKE, Inc., Beaverton, OR (US)

(72) Inventors: Shane S. Kohatsu, Portland, OR (US); Matthew C. Palmer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 22 days.

(21) Appl. No.: 17/517,475

(22) Filed: Nov. 2, 2021

(65) Prior Publication Data

US 2022/0132997 A1 May 5, 2022

Related U.S. Application Data

(60) Provisional application No. 63/109,281, filed on Nov. 3, 2020.

(51) Int. Cl.
*A43B 23/02* (2006.01)
*A43B 7/12* (2006.01)
(Continued)

(52) U.S. Cl.
CPC ..... *A43C 11/008* (2013.01); *A43B 7/12* (2013.01); *A43B 23/0235* (2013.01);
(Continued)

(58) Field of Classification Search
CPC ..... A43B 23/0235; A43B 23/0275; A43B 23/088; A43B 23/16; A43B 23/17
See application file for complete search history.

(56) References Cited

U.S. PATENT DOCUMENTS 4,594,798 A * 6/1986 Autry ..... A43B 23/17 36/114
4,972,613 A * 11/1990 Loveder ..... A43B 11/00 36/105
(Continued)

FOREIGN PATENT DOCUMENTS

CN 104902772 A 9/2015
JP H10-304904 A 11/1998
(Continued)

OTHER PUBLICATIONS

The International Search Report and The Written Opinion of the International Searching Authority dated Feb. 14, 2022, from International Patent Application No. PCT/US2021/057736, 14 pp.
(Continued)

*Primary Examiner* — Megan E Lynch
*Assistant Examiner* — Giao Qt Hoang
(74) *Attorney, Agent, or Firm* — Klarquist Sparkman, LLP

(57) ABSTRACT

An article of footwear includes a sole structure, an upper, and a securing mechanism. The upper comprises a toe region, a midfoot region, a heel region, a lateral side, and a medial side, and is coupled to the sole structure. The securing mechanism is fixedly attached to the upper and comprises a forefoot portion and a heel lock element. The heel lock element has a first and a second end and extends from the lateral side of the upper, passes around the heel region of the upper, and extends to the medial side of the upper. The heel lock element comprises a stiffness that is greater than the stiffness of the upper and is configured such that tensioning the securing band adjusts the heel segment of the main portion relative to a wearer's heel.

16 Claims, 5 Drawing Sheets

(51) Int. Cl.

| | |
|---|---|
| ***A43B 23/16*** | (2006.01) |
| ***A43B 23/17*** | (2006.01) |
| ***A43C 1/00*** | (2006.01) |
| ***A43C 11/00*** | (2006.01) |

(52) U.S. Cl.
CPC ..... *A43B 23/0245* (2013.01); *A43B 23/0275* (2013.01); *A43B 23/16* (2013.01); *A43B 23/17* (2013.01); *A43C 1/00* (2013.01)

(56) References Cited

U.S. PATENT DOCUMENTS

| | | | | |
|---|---|---|---|---|
| 5,269,078 | A * | 12/1993 | Cochrane | A43B 7/20 36/170 |
| 5,408,761 | A | 4/1995 | Gazzano | |
| 5,430,959 | A | 7/1995 | Mitsui | |
| 9,060,567 | B2 | 6/2015 | Elder et al. | |
| 2004/0181972 | A1 | 9/2004 | Csorba | |
| 2004/0250452 | A1 | 12/2004 | Farys | |
| 2006/0117607 | A1* | 6/2006 | Pare | A43C 1/04 36/50.1 |
| 2006/0265910 | A1 | 11/2006 | Lampley | |
| 2009/0300947 | A1* | 12/2009 | Babolat | A43B 7/20 36/114 |
| 2011/0113650 | A1* | 5/2011 | Hurd | A43B 7/20 36/107 |
| 2011/0225843 | A1* | 9/2011 | Kerns | A43B 3/0052 36/50.1 |
| 2016/0242498 | A1* | 8/2016 | Sakamoto | A43B 13/04 |
| 2016/0345673 | A1* | 12/2016 | Humphrey | A43C 19/00 |
| 2017/0231319 | A1* | 8/2017 | Bohnsack | A43B 13/04 36/92 |
| 2018/0249787 | A1* | 9/2018 | Fuerst, Sr. | A43B 1/04 |
| 2018/0255873 | A1 | 9/2018 | Roy et al. | |
| 2019/0313740 | A1* | 10/2019 | Workman | A43B 7/20 |

FOREIGN PATENT DOCUMENTS

| | | | |
|---|---|---|---|
| WO | WO 2014/113356 | A1 | 7/2014 |
| WO | WO 2017/024166 | A1 | 2/2017 |

OTHER PUBLICATIONS

Office Action of the Intellectual Property Office issued Aug. 2, 2022, ROC (Taiwan) Patent Application No. 110140894, in Mandarin Chinese and with an English translation (32 pages).

* cited by examiner

SECURING MECHANISMS FOR ARTICLES OF FOOTWEAR

CROSS REFERENCE TO RELATED APPLICATION

This application claims the benefit of the earlier filing date of U.S. Provisional Patent Application No. 63/109,281, filed on Nov. 3, 2020, which is incorporated herein by reference in its entirety.

FIELD

The present disclosure is directed to articles of footwear and, more particularly, to securing mechanisms for articles of footwear.

BACKGROUND

An article of footwear (also referred to herein as "article") typically includes two main components: a sole structure and an upper. The sole structure is configured for supporting the wearer's foot and providing cushioning between the wearer's foot and the ground. The upper is coupled to the sole structure and is configured for securing the wearer's foot to the sole structure.

BRIEF DESCRIPTION

Aspects and advantages of the disclosed technology will be set forth in part in the following description, or may be obvious from the description, or may be learned through practice of the technology disclosed in the description.

Disclosed herein are articles of footwear that can provide, for example, controlled flexibility, improved strength, and/or increased support. In particular, the articles of footwear disclosed herein comprise a heel lock element that can improve the conformity of the upper to the ankle, heel, and instep of the foot, while leaving the remainder of the upper more loosely-fitted for comfort and mobility.

In some embodiments, an article of footwear comprises an upper, a sole structure, and a securing mechanism. The upper comprises a toe region, a midfoot region, and a heel region, a lateral side, a medial side. The sole structure is coupled to the upper so as to define a foot-receiving cavity therebetween. The line along which the upper and the sole structures are connected is, in some embodiments referred to as the "bite line". The securing mechanism further comprises a forefoot region and a heel lock element and is disposed on and fixedly attached to the upper. The forefoot region is disposed along the instep of a wearer's foot. The heel lock element attaches to the lateral and medial sides of the upper and is disposed to wrap around the heel region of the upper. The heel lock element has a greater stiffness than the upper and is further configured to come under tension when the shoelaces are tightened, causing the upper to conform more closely to the shape of the wearer's foot, ankle, and instep.

In some embodiments, an article of footwear comprises an upper and a sole structure. The upper comprises a toe region, a midfoot region, and a heel region, a lateral side and a medial side. The sole structure is coupled to the upper so as to define a foot-receiving cavity therebetween. The line along which the upper and the sole structures are connected is, in some embodiments referred to as the "bite line." The upper further comprises a throat, and a tongue. The throat is disposed along instep of the forefoot and has a lateral side and a medial side. A first set of eyelets and a second set of eyelets are disposed on the lateral and medial sides of the throat. The first and second set of eyelets are configured to receive shoelaces. The upper further comprises a heel lock element which attaches to the lateral and medial sides of the throat and is disposed to wrap around the heel region of the upper. The heel lock element is further configured to attach to the sole structure. The heel lock element is further configured to come under tension when the shoelaces are tightened, causing the upper and sole to conform more closely to the shape of the wearer's foot, ankle, and instep.

Also disclosed herein are securing mechanisms for an article of footwear. The securing elements disclosed herein can comprise, for example, a heel lock element that can secure the upper of a shoe to the ankle, heel, and instep of the foot, while leaving the remainder of the upper more loosely-fitted for comfort and mobility.

In some embodiments, the securing mechanism comprises a forefoot region and a heel lock element. The heel lock element may have a first and second end and be configured to extend from a lateral side of a corresponding upper of an article of footwear, pass around the heel of the article of footwear, and extend to the medial side of the article of footwear. The heel lock element may be fixedly attached to the corresponding upper. The heel lock element may have a stiffness greater than that of the corresponding upper and be configured to adjust the heel segment of the corresponding upper when tensioned.

These and other features, aspects, and/or advantages of the present disclosure will become better understood with reference to the following description and the claims. The accompanying drawings, which are incorporated in and constitute a part of this specification, illustrate embodiments of the disclosed technology and, together with the description, explain the principles of the disclosure.

DETAILED DESCRIPTION

General Considerations

Figure 1:
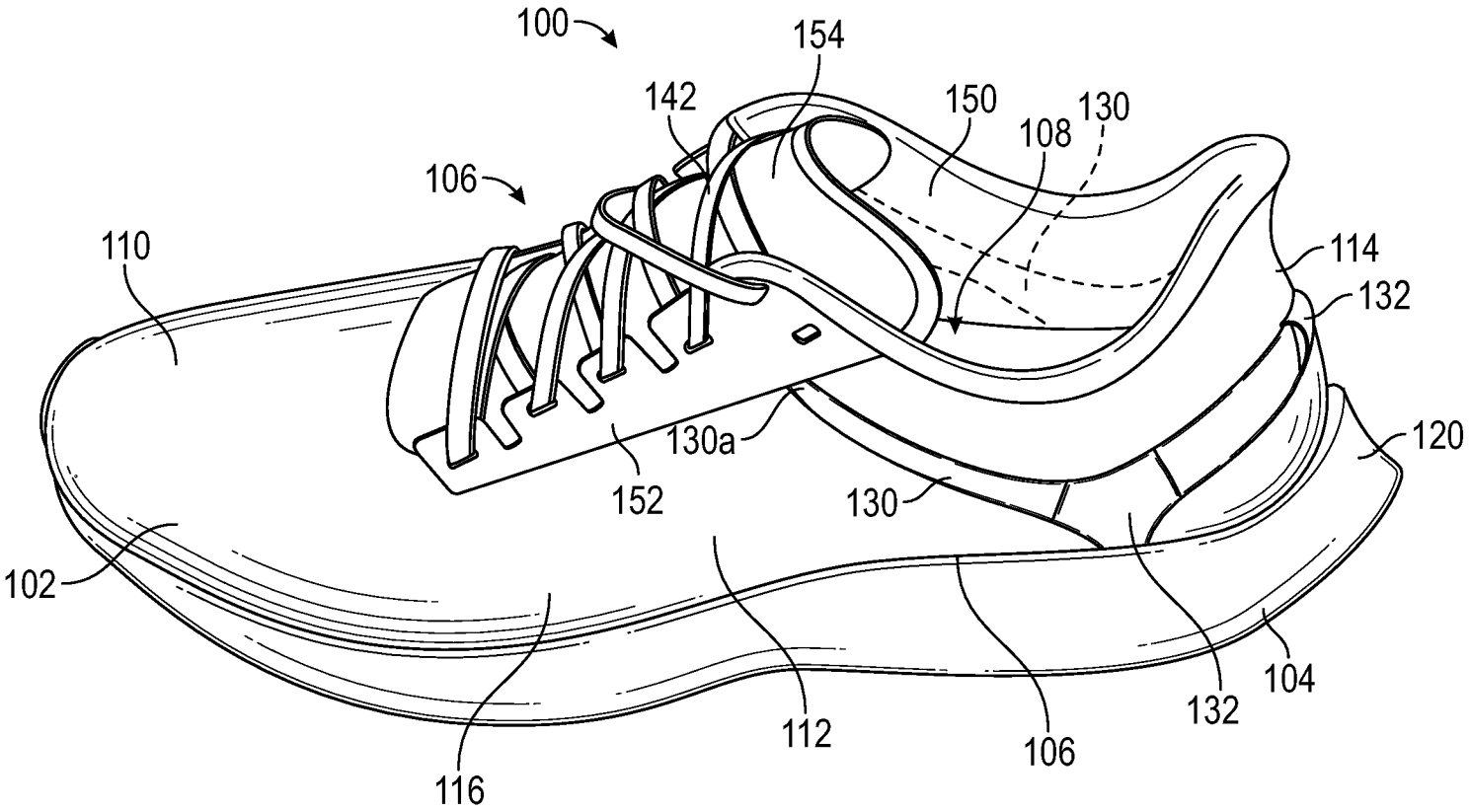
FIG. 1 depicts a perspective view of an exemplary embodiment of the article of footwear, depicting a lateral side of the article of footwear.

The systems and methods described herein, and individual components thereof, should not be construed as being limited to the particular uses or systems described herein in any way. Instead, this disclosure is directed toward all novel and non-obvious features and aspects of the various disclosed embodiments, alone and in various combinations and subcombinations with one another. For example, any features or aspects of the disclosed embodiments can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present, or problems be solved.

As used in this application, the singular forms "a," "an," and "the" include the plural forms unless the context clearly dictates otherwise. Additionally, the term "includes" means "comprises." Further, the terms "coupled" or "secured" encompass mechanical and chemical couplings, as well as other practical ways of coupling or linking items together, and do not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations.

Although the operations of some of the disclosed methods are described in a particular, sequential order for convenient presentation, this manner of description encompasses rearrangement, unless a particular ordering is required by specific language set forth below. For example, operations described sequentially may in some cases be rearranged or performed concurrently. Moreover, for the sake of simplicity, the attached figures may not depict the various ways in which the disclosed things and methods can be used in conjunction with other things and methods. Additionally, the description sometimes uses terms like "provide" and "produce" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the directional terms (e.g., "upper" and "lower") generally correspond to the orientation of an article of footwear or sole assembly as it is configured to be worn by a wearer. For example, an "upwardly-facing surface" and/or an "upper surface" of a sole assembly refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body." "Longitudinal axis" refers to a centerline of the article from the heel to toe. Similarly, a "longitudinal length" refers to a length of the article along the longitudinal axis and a "longitudinal direction" refers to a direction along the longitudinal axis.

As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole and an inner sole.

As used herein, the term "upper" refers to any combination of materials that encloses the wearer's foot from the top and sides. A typical upper is coupled to the sole structure at line that is sometimes called the "bite line". Taken together, the upper and the sole structure define a cavity that holds the foot of the wearer, usually called the "foot receiving cavity." A typical upper may be designed to conform to the wearer's foot when under stress from the securing mechanism.

As used herein, the term "securing mechanism" refers to any combination of materials and features that serve to adjustably apply force to the upper to cause it to conform more closely to the foot. For example, the securing mechanism may be laces, but other mechanisms (e.g. straps, cables, cords, buckles, ratcheting mechanisms, hook and loop fastener) may be used to ensure conformity of the forefoot region of the upper. The securing mechanism may contain additional elements to provide conformity of other regions of the upper.

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the terms "fixedly attached" and "fixedly coupled" refer to two components joined in a manner such that the components may not be readily separated from one another without destroying and/or damaging one or both components. Exemplary modalities of fixed attachment may include joining with permanent adhesive, stitches, welding or other thermal bonding, and/or other joining techniques. In addition, two components may be "fixedly attached" or "fixedly coupled" by virtue of being integrally formed, for example, in a molding process. In contrast, the terms "removably attached" or "removably coupled" refer to two components joined in a manner such that the components can be readily separated from one another to return to their separate, discrete forms without destroying and/or damaging either component. Exemplary modalities of temporary attachment may include mating-type connections, releasable fasteners, removable stitches, and/or other temporary joining techniques.

As used herein, the terms "articles of footwear," "articles," and/or "footwear" mean any type of footwear, including, for example, casual shoes, walking shoes, sneakers, tennis shoes, running shoes, soccer shoes, football shoes, rugby shoes, basketball shoes, baseball shoes, boots, sandals, etc.

Although the figures may illustrate an article of footwear intended for use on only one foot (e.g., a right foot) of a wearer, one skilled in the art and having the benefit of this disclosure will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, abstract, and drawings.

Introduction to the Disclosed Technology

As mentioned above, an article of footwear typically includes three main components: a sole structure an upper, and a securing mechanism. The sole structure is configured for supporting the wearer's foot and providing cushioning between the wearer's foot and the ground. The upper is coupled to the sole structure and is configured for securing the wearer's foot to the sole structure. The upper together with the sole structure form a foot-receiving cavity therebetween. The securing mechanism adjustably applies force to the upper and, in some embodiments to the sole structure, to cause the upper and/or sole structure to conform more or less closely to the foot of the wearer.

The upper of the article of footwear is configured to enclose the wearer's foot and, when coupled to the sole structure, to form the foot-receiving cavity of the article of footwear. The upper is typically formed of a flexible outer shell and can be conformed to the foot of the wearer by the securing mechanism. The upper may be formed of one or materials including textiles, foam, leather, polymers, and/or synthetic leather, selected for resilience, durability or wearer comfort.

Articles of footwear typically include a securing mechanism (e.g., laces, straps, etc.) that are used to allow the foot-receiving cavity to be adjusted. More specifically, the securing mechanism can be loosened to allow a wearer's foot to be inserted into or removed from the foot-receiving cavity. The securing mechanism can be tightened to secure the wearer's foot within the foot-receiving cavity.

Typical securing mechanisms are disposed on the forefoot region of the article of footwear. As such, most of the adjustment to the upper occurs on the front part of the article. Thus, typical securing mechanisms may aid in conforming the front region of the article of footwear to the wearer's foot. However, typical securing mechanisms, do little to aid with adjustment of the heel region of the article of footwear. As a result, typical articles of footwear may allow the wearer's heel to move relative to the article of footwear as the wearer moves. This undesired movement can result in discomfort (e.g., skin irritation and/or blisters) and/or less efficient movement. These problems are compounded by a wide degree of variability in the anatomy of feet, particularly in the heel and Achilles tendon region, as well as relatively rigid heel structures (e.g., heel cups) that are need for other reasons (e.g., lateral stability).

Accordingly, articles of footwear with improved securing mechanisms that can, for example, secure the wearer's heel relative to the article of footwear are desired.

Disclosed Technology and Exemplary Embodiments

Disclosed herein are articles of footwear comprising securing mechanisms that can, for example, provide greater conformity of the heel region of the upper to the foot of the wearer to reduce slippage, discomfort, and/or wear during use. In particular, the articles of footwear disclosed herein comprise a securing mechanism with a heel lock member (also referred to herein as a "fastening band") that can draw the heel region of the article of footwear forward and down to secure it against the wearer's heel.

In some embodiments, the disclosed heel lock members be integrated with a traditional securing mechanism disposed on the forefoot of the article of footwear. As such, a wearer can achieve a more secure and/or comfortable fit without requiring further adjustment (e.g., beyond just tightening the laces or straps). In this manner, the disclosed heel lock members can, for example, work synergistically with the securing mechanism on the front of the article of footwear to securing the wearer's foot relative to the article of footwear. For example, laces at the front of the article of footwear can conform the forward portions of the upper to the forefoot region of the wearer's foot. The laces can also pull the wearer's foot downward and rearward. As tension in the laces is increased, the tension of the heel lock member can also increase and conform the rearward portions of the upper to the heel region of the wearer's foot. The heel lock member can also pull the heel of the wearer's foot downward and forward. Thus, the laces (or other type of securing mechanism on the forefoot) and the heel lock member together can synch the wearer's foot to the footbed of the article of footwear and thereby reduce relative movement between the wearer's foot and the article of footwear.

The disclosed articles of footwear comprising securing mechanisms with a heel lock member can be advantageous, for example, when used for activities with repetitious movements (e.g., running) and/or activities with frequent acceleration/deceleration (e.g., tennis, basketball, soccer, etc.). The disclosed articles of footwear can also advantageously accommodate a relatively wider range of anatomical variation.

In some embodiments, the heel lock member or heel lock element can have a lateral and a medial end and can extend around the heel region of the article of footwear. The lateral and medial ends of the heel lock member or heel lock element can connect to lateral and medial edge regions of the midfoot region of the article of footwear, such that the force used to close the article of footwear around the foot of the wearer will further tension the heel lock member or heel lock element. In some examples, the heel lock member can further attach to the sole region at the "bite line" to further draw the heel region down and forward against the wearer's heel.

In some alternative embodiments, the lateral and medial ends of the heel lock members have holes or eyelets that permit the securing mechanism (e.g., laces, cords, etc.) to pass directly through the ends of the heel lock member, rather than requiring the heel lock member to be attached to the lateral and medial portions of the throat of the article of footwear. In this way, tension on the securing mechanism is directly translated to the heel lock member, rather than first to the throat of the article of footwear and thereby to the heel lock member.

The heel lock member may be attached to the upper in a variety of ways. In some embodiments, the upper of the article of footwear will have a top segment and a bottom segment, with the heel lock member disposed between the top and the bottom segments, and fixedly attached to both segments. In other embodiments, the upper will have an inner layer and an outer layer, with the heel lock member disposed between the two layers and fixedly attached to one or both layers.

In yet other embodiments, the heel lock member may be disposed either along the inside or the outside of the upper. In various alternatives on these embodiments, the heel lock member may be either fixedly attached to the inside or outside surface of the upper or may be disposed such that the heel lock member is fully or partially inset within the upper.

For example, FIGS. 1-5 depict an exemplary article of footwear 100 and its components. The article of footwear 100 comprises a securing mechanism with a heel lock member, according to one embodiment.

Figure 2:
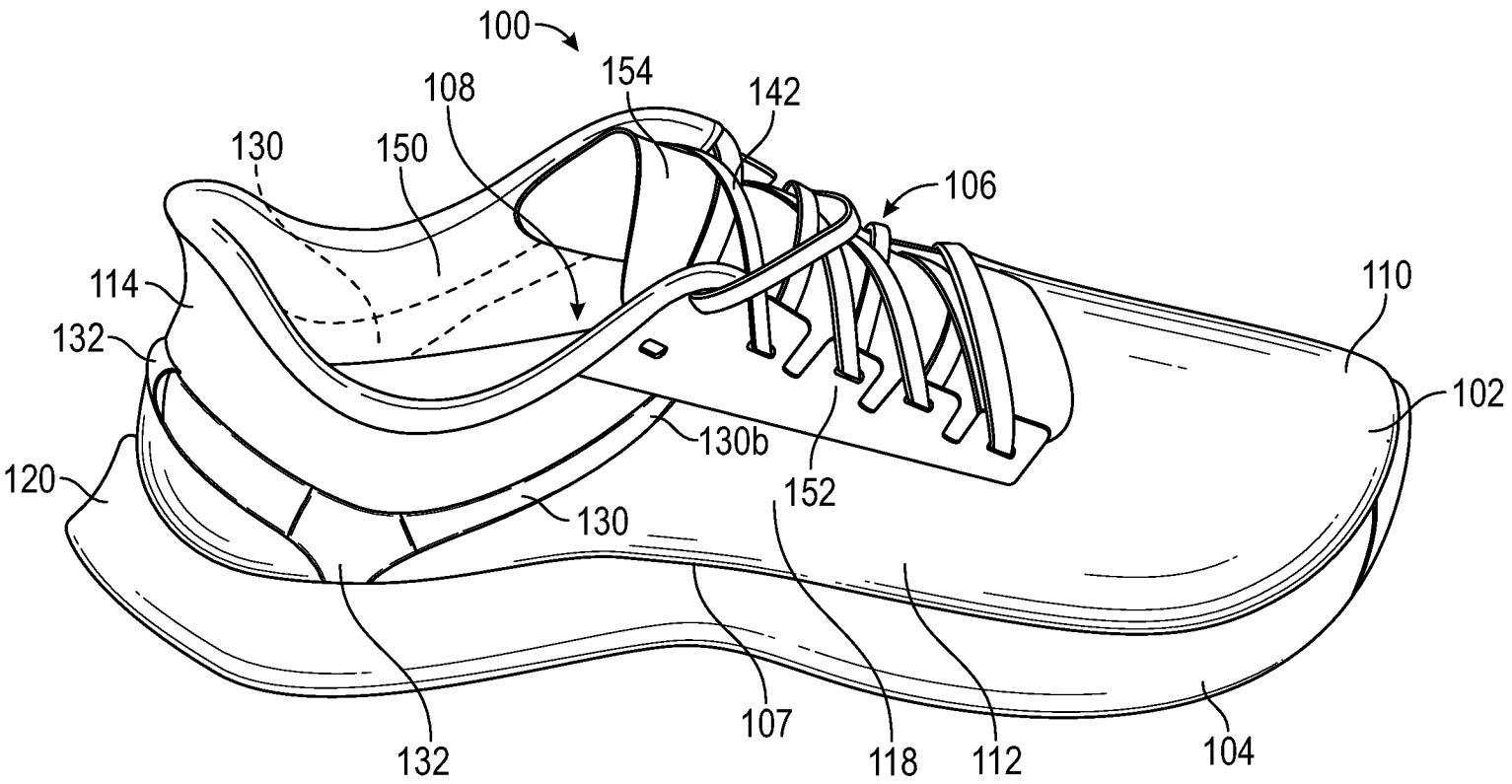
FIG. 2 depicts a perspective view of the article of footwear of FIG. 1, depicting a medial side of the article of footwear.

Referring to FIGS. 1-2, the article of footwear 100 comprises an upper 102, a sole structure 104, and a securing mechanism 106. The upper 102 is coupled to and extends from the sole structure 104 at a bite line 107, thereby forming a foot-receiving cavity 108 therebetween. The securing mechanism 106 is coupled to the upper 102 (and in some instances the sole structure 104) and can be used to adjust the foot-receiving cavity 108. More specifically, the securing mechanism 106 can be loosened to allow a wearer's foot to be inserted into or removed from the foot-receiving cavity 108, and the securing mechanism 106 can be tightened to secure the wearer's foot within the foot-receiving cavity 108.

The article of footwear 100 can be divided into one or more portions (which can also be referred to as "zones," "regions," or "sections"). For example, referring to FIGS. 1-2, in an anterior-posterior direction, the article of footwear 100 (and/or its components) can be divided into (and/or include) a forefoot portion 110, a midfoot portion 112, and a heel portion 114. The forefoot portion 110 of the article of footwear 100 can correspond to anterior portions of a foot, including toes and joints connecting metatarsal bones with phalanx bones of the foot. The midfoot portion 112 of the article of footwear 100 can correspond with an arch area of the foot. The heel portion 114 of the article of footwear 100 can correspond with posterior portions of the foot, including a calcaneus bone.

In a medial/lateral direction, the article of footwear 100 (and/or its components) can be divided into a lateral side portion 116 and a medial side portion 118, both of which extend through the forefoot portion 110, the midfoot portion 112, and the heel portion 114. For example, FIG. 1 depicts the lateral side portion 116 of the article of footwear 100, and FIG. 2 depicts the medial side portion 118 of the article of footwear 100.

The article of footwear 100 can also be described in reference to a superior/inferior direction. For example, in the orientation depicted in FIGS. 1-2, the superior direction is up, and the inferior direction is down.

As shown in FIGS. 1-2, the upper 102 can comprise a throat portion 152 separating the lateral side of the upper 102 and the medial side of the upper 102. The upper 102 also comprises a tongue 154 disposed at least partially within the throat portion 152. In other embodiments, the upper 102 can be formed without a throat portion and/or a tongue.

The upper 102 of the footwear 100 can be formed of various materials. For example, the upper 102 can be formed of one or more of the following materials: textiles, foam, leather, polymers, and/or synthetic leather. In some embodiments, the upper 102 can be formed as a single, unitary component (e.g., by knitting or molding). In other embodiments, the upper 102 can comprise a plurality of components that are coupled together (e.g., by stitching, adhesive, fasteners, etc.).

The upper may be described as having an inner and outer surface. The inner surface is disposed towards the foot-receiving cavity formed by the joint upper and sole structure of the article of footwear. The outer surface is disposed away from the foot-receiving cavity and can form a part of the exterior of article of footwear.

The upper 102 can be fixedly coupled to the sole structure 104 in various ways. The upper 102 can be attached (e.g., stitched) to a strobel, and the strobel can be attached to the midsole 120 (e.g., with an adhesive). In other embodiments, the strobel can be omitted, and the upper 102 can be attached to a component of the sole structure 104. In some such embodiments, the upper 102 can be directly attached to the midsole 120 and/or a cushioning element (e.g., an airbag) of the sole structure 104 via adhesive, stitching, and/or other means for coupling.

The sole structure 104 can be coupled to the upper 102 in various ways. For example, in some instances, the sole structure 104 and the upper can be coupled together with adhesive, fasteners, stitching, and/or other means for coupling. In certain embodiments, the article of footwear 100 can include a strobel that is coupled (e.g., sewn) to an inferior portion of the upper 102, and the strobel can be coupled to the midsole 120 (e.g., via adhesive).

The midsole 120 of the sole structure 104 is configured to be positioned under the wearer's foot. As such, the midsole 120 can, for example, be configured to provide cushioning and support. The midsole 120 can be configured to flex and/or elastically deform as the wearer's foot applies pressure upon the midsole 120 and/or as the article of footwear 100 impacts a ground surface. In some embodiments, the midsole 120 can comprise relatively flexible foam material.

The article of footwear 100 can, in some instances, further comprise a sockliner (which may also be referred to as "an insole"). The sockliner can be configured to be positioned directly underfoot and is configured to cushion and/or support the wearer's foot. The sockliner can comprise various materials including textile, leather, foam, and/or other types of materials.

The securing mechanism 106 comprises a forefoot portion and a heel portion. The forefoot portion of the securing mechanism 106 can include one or more laces 142, as depicted in the illustrated embodiment. In lieu of or in addition to the laces 142, the forefoot portion of the securing mechanism 106 can include one or more of straps, bands, cables, cords, ratcheting mechanisms, buckles, hook-and-loop fasteners, and/or other means for securing a forefoot portion of an article of footwear.

The heel portion of the securing mechanism 106 comprises a heel lock element 130 and one or more anchoring elements 132 (e.g., three in the illustrated embodiment). The heel lock element 130 is coupled to the upper and extends from a first location on a lateral side of the upper adjacent the midfoot region, around the heel region of the upper, to a second location on a medial side of the upper 102 adjacent to the midfoot region. The heel lock element 130 is stiffer (e.g., less stretchable) than the upper 102. As such, tensioning the heel lock element can result in elastic deformation of the upper 102. The heel lock element 130 extends through the anchoring elements 132. The anchoring elements 132 are stiffer (e.g., less stretchable) than the heel lock element 130. As such, the anchoring elements 132 can be used to guide the heel lock element 130 as tension in the heel lock element 130 is adjusted.

As shown in FIGS. 1-2, the heel lock element 130 can have a lateral end 130*a* and a medial end 130*b*. The heel lock element 130 extends from the lateral side 116 of midfoot portion 112, around the heel portion 114, and to the medial side 118 of the midfoot of the midfoot portion 112. The lateral end 130*a* is, in some embodiments, attached to the lateral side of the midfoot portion 112. The medial end 130*b* of heel lock element 130 can be attached to the medial side 118 of the midfoot of the midfoot portion 112. The heel lock element 130 is typically fixedly attached to the upper 102. This fixed attachment may be achieved by a variety of means, e.g. stitching, gluing, lamination, etc.

The locations at which the lateral end 130*a* and medial end 130*b* of the heel lock element 130 attach to the lateral and medial portions of midfoot region 112 may be selected to direct securing force applied by the heel lock element 130. For example, an attachment nearer to the forward (i.e. closer to the toe) end of midfoot portion 112 may result in a securing force that is directed laterally against the heel and forefoot of the wearer, whereas an attachment nearer the rear (i.e. closer to the heel) end of midfoot portion 112 may result in more downwards force on the heel of the wearer.

In some alternative embodiments the lateral end 130*a* and medial end 130*b* of the heel lock element 130 may have holes, eyelets, apertures, or other openings. These openings may be configured to allow the laces 142 or any other components of the forefoot portion of securing mechanism 106, such as straps, bands, cables, cords, ratcheting mechanisms, buckles, hook-and-loop fasteners, and/or other means for securing a forefoot to pass through. This will allow direct tensioning of heel lock element 130 when the forefoot portions of the securing mechanism 106 are tightened.

In embodiments having a throat 152 and a tongue 154, the lateral end 130*a* and medial end 130*b* of the heel lock element 130 may attach to the lateral and medial sides of the throat 152. This may be done with embodiments of the heel lock element 130 both with and without holes, eyelets, apertures, or any other openings.

The heel portion of securing mechanism 106 may further include one or more anchoring elements 132. Anchoring elements 132 are typically formed of a more rigid or stiff material than heel lock element 130, and function to direct the stress imparted to the upper by heel lock element 130, such as in a forward or downward direction with respect to the foot of the wearer. Anchoring elements 132 further function to secure the heel lock element 130 against the upper 102.

In an anterior-posterior direction, the anchoring elements may be positioned in various positions along the article of footwear. As shown in the illustrated embodiment of FIGS. 1-4, the anchoring elements 132 may be disposed on lateral side 116 and medial side 118 near the ankle of a wearer. Anchoring elements 132 may also be disposed on the heel portion 114 of the article of footwear 100. In some embodiments, the anchoring elements 132 may be disposed along the midfoot portion 112. In a vertical direction, anchoring elements may be disposed towards the bottom of the upper 102, adjacent to the bite line 107, or further up the upper 102 above the bite line 107, as shown in FIGS. 1-4.

The location of the anchoring elements 132 may be selectively configured to control the direction of the force applied by the heel lock element 130. For example, an anchoring element 132 disposed on the heel portion 114 of the upper 102 may be positioned higher to direct the force downwards against the calcaneus of a wearer's heel. The anchoring element 132 might also be positioned lower on the heel portion 114 of the upper 102 to direct the force more forwards against the calcaneus of a wearer's heel. Similarly, positioning anchoring elements 132 disposed on the lateral side 116 and medial side 116 of the article of footwear 100 further towards the midfoot region 112 of the upper 102 may result in a more forwards force, and positioning the anchoring elements 132 further towards the heel portion 114 of the upper 102 may result in a more downwards force.

Figure 3:
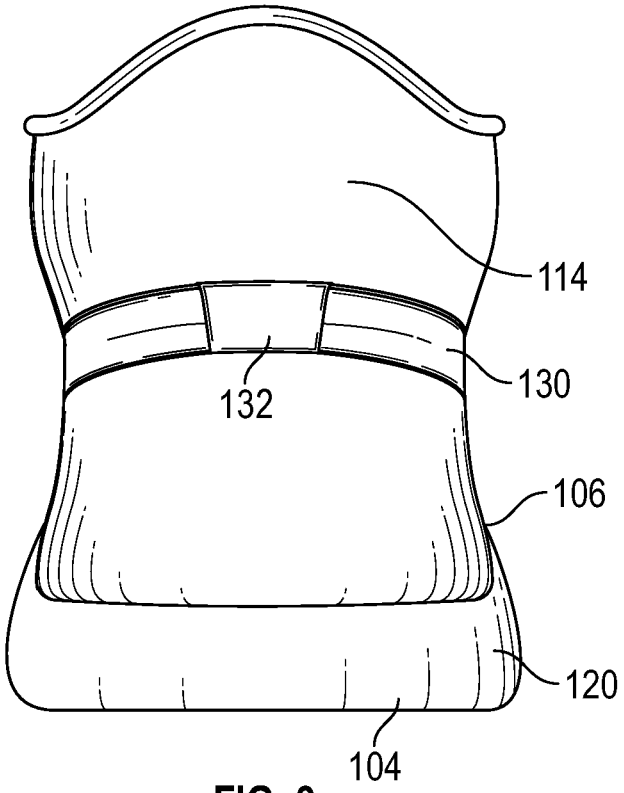
FIG. 3 depicts a rear view of the article of footwear of FIG. 1.
Figure 4:
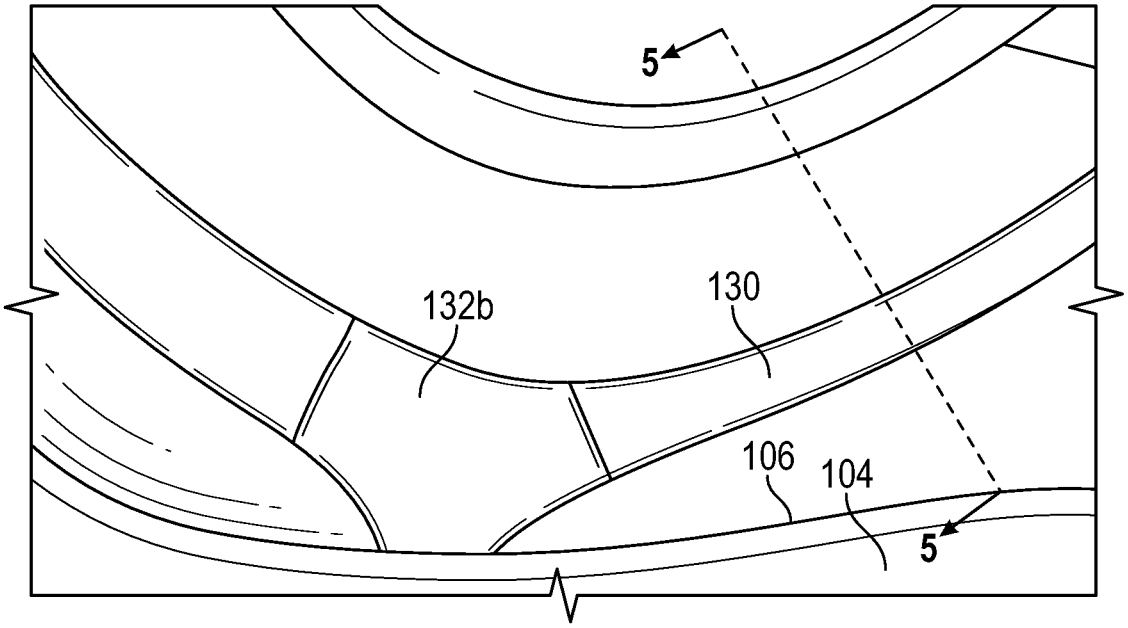
FIG. 4 depicts a detail view of the medial side of the article of footwear of FIG. 1.

In certain preferred embodiments shown in the exemplary illustrations, one anchoring element 132 is disposed on lateral side 116, one anchoring element 132 is disposed on medial side 118, and one anchoring element 132 is disposed on the heel portion 114 of the article of footwear 100. In the illustrated embodiment in FIGS. 1-2, anchoring elements 132 disposed on the sides of the article of footwear attach to the heel lock element 130, the upper 102 and the sole structure 104 at a position adjacent to the bite line 107. As shown in FIGS. 1-3, the anchoring element 132 disposed on the heel portion 114 attaches to heel lock element 130 and upper 102 at a position above the sole structure 104 and bite line 107.

The heel lock element is fixedly attached to the upper of the article of footwear. The heel lock element may be disposed in a variety of different configurations in relation to the upper of the article of footwear. The specific configuration used in any particular embodiment may be selected for a variety of reasons. For example, the heel lock element may be disposed towards the exterior of the upper for wearer comfort, or it may be disposed on the interior of at least one layer of the upper to protect the heel lock element or for aesthetic reasons. The fixed attachment of the heel lock element may be accomplished by stitching, gluing, lamination, or any other method suitable for attaching one layer of material to one or more other layers.

Figure 5:
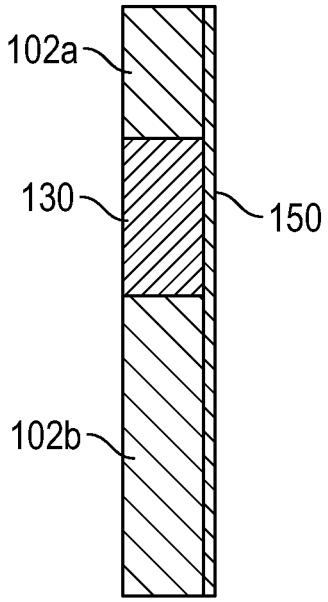
FIG. 5 depicts a schematic cross-sectional view of the article of footwear, taken along the line 5-5 as depicted in FIG. 4.
Figure 6:
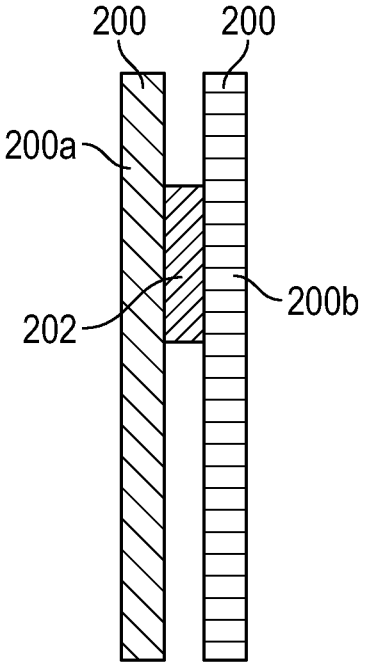
FIG. 6 depicts a schematic cross-sectional view of another exemplary article of footwear, taken from a perspective similar to that depicted in FIG. 5.

As shown in FIGS. 5-6, the upper of the article of footwear may be divided into two or more portions (e.g. an inner portion, an outer portion, a top portion, a bottom portion). In these embodiments, the heel lock element is disposed between the two or more portions of the upper and serves to connect the portions of the upper along some or all of the length of the heel lock element.

As depicted in FIG. 5, the upper 102 of the article of footwear 100 may be separated into a top section 102*a* disposed towards the superior portion of the article of footwear 100 and a bottom section 102*b* disposed towards the inferior portion of the article of footwear 100. In this embodiment, the heel lock element 130 is disposed between the top section 102*a* and the bottom section 102*b* of the upper 102 and is fixedly attached to both sections to form a single piece. The heel lock element 130 fixedly attached in this way may be stitched, glued, or laminated to the top section 102*a* and the bottom section 102*b* of the upper 102 along some or all of their lengths. This disposition of the heel lock element may be selected to minimize the total thickness of the combined upper 102 and heel lock element 130.

In some alternative embodiments there may further be an interior liner 150 disposed on the inside of the upper 102 and/or the heel lock element 130 as depicted in FIG. 5. This interior liner 150 may serve, for example, to cushion or protect the foot of the wearer, or to wick precipitation, or to waterproof the article of footwear 100.

FIG. 6 depicts an alternative embodiment of the separated upper 200 in which, the upper 200 may be separated into an exterior layer 200*a* and an interior layer 200*b*. This embodiment may allow, for example, the heel lock element 202 to be both hidden for aesthetic purposes and separated from the foot of a wearer to enhance comfort. In this embodiment heel lock element 202 may be disposed between exterior layer 200*a* and interior layer 200*b* and can be fixedly attached to one or both layers. This disposition of the heel lock element 202 may be selected to simultaneously cushion the wearer's foot from heel lock element 202 and cover heel lock element 202, to protect it from wear and/or for aesthetic reasons.

Figure 7:
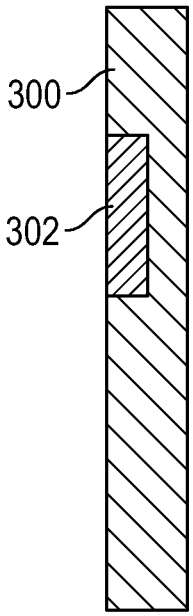
FIG. 7 depicts a schematic cross-sectional view of another exemplary article of footwear, taken from a perspective similar to that depicted in FIG. 5.
Figure 8:
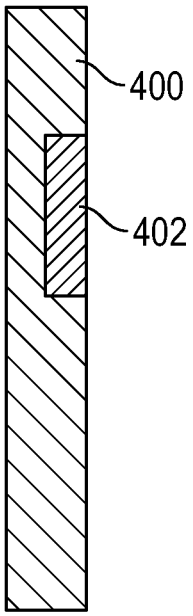
FIG. 8 depicts a schematic cross-sectional view of another exemplary article of footwear, taken from a perspective similar to that depicted in FIG. 5.
Figure 9:
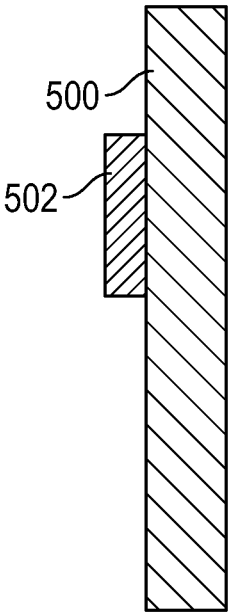
FIG. 9 depicts a schematic cross-sectional view of another exemplary article of footwear, taken from a perspective similar to that depicted in FIG. 5.
Figure 10:
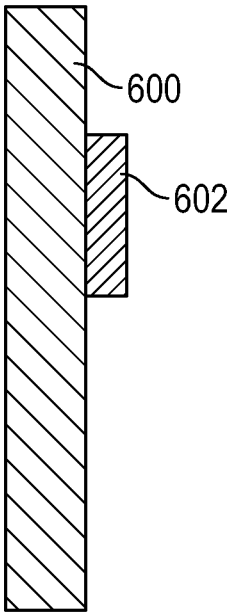
FIG. 10 depicts a schematic cross-sectional view of another exemplary article of footwear, taken from a perspective similar to that depicted in FIG. 5.

As depicted in FIGS. 7-10, the upper of the article of footwear may also be a single undivided piece to which the heel lock element is fixedly attached. In some embodiments, the heel lock element may be inset in the upper, as shown in FIGS. 7-8. In other embodiments, the heel lock element may be fixedly attached to the surface of the upper as shown in FIGS. 9-10.

FIG. 7 shows an exemplary embodiment in which the heel lock element 302 may be inset from the outer surface of the upper 300. In alternative embodiments as depicted in FIG. 8, the heel lock element 402 may be inset from the inner surface of the upper 400. Alternative embodiments such as those shown in FIGS. 7-8 may be selected to minimize the thickness of the combined upper and heel lock element, to enhance wearer comfort, and/or for aesthetic reasons.

In the alternative embodiment depicted in FIG. 9, the heel lock element 502 may be attached to the outer surface of the upper 500. In the alternative embodiment depicted in FIG. 10, the heel lock element 602 may be attached to the inner surface of the upper 600. Alternative embodiments such as those shown in FIGS. 9-10 may be selected to provide greater ease of manufacturing the upper or greater ease in selecting the position of the heel lock element to adjust the applied fastening forces.

In these various embodiments, the fixedly attached heel lock element may be, for example, stitched, glued, or laminated to the upper along some or all of its length. The disposition of the heel lock element (i.e., whether the band is attached to the surface of the upper or inset from the surface of the upper), and whether it is attached to or inset from the interior or exterior surface of the upper may depend on a number of considerations, such as functionality, comfort, and aesthetics.

Further aspects of the disclosure are provided by the subject matter of the following examples:

1. An article of footwear comprises a sole structure, an upper, and a securing mechanism. The upper comprises a toe region, a midfoot region, a heel region, a lateral side, and a medial side, and is coupled to the sole structure. The securing mechanism is fixedly attached to the upper and comprises a forefoot portion and a heel lock element. The heel lock element has a first and a second end and extends from the lateral side of the upper, passes around the heel region of the upper, and extends to the medial side of the upper. The heel lock element comprises a stiffness that is greater than the stiffness of the upper and is configured such that tensioning the securing band adjusts the heel segment of the main portion relative to a wearer's heel.

2. The article of footwear of any example herein, wherein the forefoot portion of the securing mechanism is disposed on the top of the midfoot region of the upper.

3. The article of footwear of any example herein, wherein the forefoot portion of the securing mechanism further comprises one or more of laces, straps, bands, cables, cords, ratcheting mechanisms, or hook-and-loop fastener.

4. The article of footwear of any example herein, wherein the forefoot portion of the securing mechanism further comprises a throat and tongue structure wherein the throat is disposed along an instep of the midfoot region and has a lateral side and wherein the tongue structure is disposed generally within the throat.

5. The article of footwear of any example herein, wherein a first set of eyelets and a second set of eyelets disposed along a lateral side and a medial side of the throat, through which a closure system passes to enable tightening of the article of footwear.

6. The article of footwear of any example herein, wherein the closure system comprises one or more of laces, straps, bands, cables, cords, ratcheting mechanisms, or hook-and-loop fastener.

7. The article of footwear of any example herein, wherein the heel lock element is an elastic material.

8. The article of footwear of any example herein, wherein the heel lock element is further attached to the upper by one or more anchoring elements.

9. The article of footwear of any example herein, wherein the one or more anchoring elements are a material of higher stiffness than the heel lock element.

10. The article of footwear of any example herein, wherein the upper comprises a top portion and a bottom portion, wherein the top portion and then bottom portion are both attached to the heel lock element to form the upper.

11. The article of footwear of any example herein, wherein the upper further comprises an inner layer and an outer layer having the heel lock element disposed between the inner layer and the outer layer and fixedly attached to one or more of the inner layer and outer layer.

12. The article of footwear of any example herein, wherein the upper comprises a single piece having an interior surface disposed towards a foot-receiving cavity and an exterior surface disposed away from the foot-receiving cavity.

13. The article of footwear of any example herein, wherein the heel lock element is inset within the exterior surface the upper.

14. The article of footwear of any example herein, wherein the heel lock element is inset within the interior surface the upper.

15. The article of footwear of any example herein, wherein the heel lock element is attached to an exterior surface of the upper.

16. The article of footwear of any example herein, wherein the heel lock element is attached to an interior surface of the upper.

17. The article of footwear of any example herein, wherein the heel lock element has one or more holes at each end to allow a closure system to pass through.

18. The article of footwear of any example herein, wherein the article of footwear further comprises a liner disposed along the inside of the upper.

19. The article of footwear of any example herein, wherein the liner does one or more of cushioning a foot of a wearer, waterproofing a foot-receiving cavity, and wicking moisture from the foot-receiving cavity.

20. An article of footwear comprises a sole structure and an upper. The upper comprises a flexible main portion having a toe region, a midfoot region, a heel region, a lateral side, and a medial side. The sole structure is coupled to the upper so as to define a foot-receiving cavity therebetween. The upper further comprises a securing mechanism, and a heel lock member. The securing mechanism may be adjustably coupled to the midfoot portion of the main section. The heel lock member further comprises a first and second end, wherein the heel lock element is fixedly secured to the main portion, and wherein the heel lock element is adjustably coupled to the securing mechanism. The heel lock element passes around the heel of the shoe, and the first and second ends of the heel lock element attach to a lateral midfoot edge region and a medial midfoot edge region, and the first and second sole attachment members attach to the sole at the bite line. The heel lock element tightens the upper of the shoe around the wearer's foot.

21. The article of footwear of any example herein, wherein the article of footwear further comprises a throat and tongue structure wherein the throat is disposed along an instep of a forefoot and has a lateral side and a medial side, and wherein the tongue structure is disposed generally within the throat.

22. The article of footwear of any example herein, wherein a first set of eyelets and a second set of eyelets are disposed along a lateral side and a medial side of the throat, through which a securing mechanism passes to enable tightening of the article of footwear.

23. The article of footwear of any example herein, wherein the securing mechanism further comprises at least one of laces, straps, bands, cables, cords, ratcheting mechanisms, and or hook-and-loop fastener.

24. The article of footwear of any example herein, wherein the heel lock member is an elastic material.

25. The article of footwear of any example herein, wherein the heel lock member is further attached to the upper by one or more anchoring elements.

26. The article of footwear of example herein, wherein the one or more anchoring elements are a material of higher stiffness than the heel lock member.

27. The article of footwear of any example herein, wherein the upper comprises an upper and lower portion, wherein the upper and lower portions are both attached to the heel lock member to form the upper.

28. The article of footwear of any example herein, wherein the upper further comprises an inner layer and an outer layer having the heel lock member disposed between the inner layer and the outer layer and fixedly attached to one or more of the inner layer and outer layer.

29. The article of footwear of any example herein, wherein the upper comprises a single piece having an interior surface disposed towards a foot-receiving cavity and an exterior surface disposed away from the foot-receiving cavity.

30. The article of footwear of any example herein, wherein the heel lock element is inset within the exterior surface of the upper.

31. The article of footwear of any example herein, wherein the heel lock element is inset within the interior surface the upper.

32. The article of footwear of any example herein, wherein the heel lock element is attached to the exterior surface of the upper.

33. The article of footwear of any example herein, wherein the heel lock element is attached to the interior surface of the upper.

34. The article of footwear of any example herein, wherein the heel lock element has one or more holes at each end to allow a securing mechanism to pass through.

35. The article of footwear of any example herein, wherein the article of footwear further comprises a liner disposed along the inside of the upper.

36. The article of footwear of any example herein, wherein the liner does one or more of: cushioning a foot of a wearer, waterproofing a foot-receiving cavity, and wicking moisture from the foot-receiving cavity.

37. A securing mechanism for an article of footwear comprising a forefoot portion and a heel lock element. The heel lock element is configured to be capable of fixed attachment to a corresponding upper of an article of footwear and to adjust a heel segment of the corresponding upper when tensioned. The heel lock element has a first end configured to attach to a lateral side of the corresponding upper of an article of footwear, a second end configured to attach to a medial side of the corresponding upper of an article of footwear, and a heel band configured to pass around the heel region of the corresponding upper, and extends to the medial side of the upper.

38. The securing mechanism of any example herein, wherein the heel lock element comprises a stiffness greater than that of the corresponding upper.

39. The securing mechanism of any example herein, wherein the heel lock element further comprises one or more anchoring elements.

40. The securing mechanism of any example herein, wherein the heel lock elements have a higher stiffness than the heel band.

41. The securing mechanism of any example herein, wherein the forefoot portion further comprises one or more of laces, straps, bands, cables, cords, ratcheting mechanisms, or hook-and-loop fastener.

42. The securing mechanism of claim any example herein, wherein the forefoot portion comprises a throat and tongue.

43. The securing mechanism of any example herein, wherein the throat comprises a lateral side, a medial side, a first set of eyelets disposed on the lateral side, and a second set of eyelets disposed on the medial side, configured to allow laces, straps, bands, cables, or cords to pass therethrough.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The invention claimed is:

1. An article of footwear comprising: a sole structure; an upper coupled to the sole structure, the upper comprising a top section with a first outer surface, a bottom section with a second outer surface, a toe region, a midfoot region, a heel region, a lateral side, and a medial side; and a securing mechanism comprising a forefoot portion and a heel lock element having a first end, a second end, a length extending between the first end and the second end, and an outermost surface that is coplanar with the first outer surface of the top section, the second outer surface of the bottom section, or both the first outer surface of the top section and the second outer surface of the bottom section, wherein the top section and the bottom section are separated by a gap recessed from the first outer surface and the second outer surface, wherein the heel lock element is embedded within the gap, wherein the heel lock element is fixedly attached to the top section of the upper and the bottom section of the upper along some or all of the length of the heel lock element, and wherein the heel lock element is an elastic material, the heel lock element has a stiffness that is greater than a stiffness of the upper, extends from the lateral side of the upper, passes around the heel region of the upper, and extends to the medial side of the upper, and is configured such that tensioning the securing mechanism adjusts the heel region of the upper relative to a wearer's heel.

2. The article of footwear of claim 1, wherein the heel lock element is further attached to the upper by one or more anchoring elements.

3. The article of footwear of claim 2, wherein the one or more anchoring elements are a material of higher stiffness than the heel lock element.

4. The article of footwear of claim 1, wherein the heel lock element has one or more holes at each end to allow a portion of a securing mechanism to pass through.

5. An article of footwear comprising: a sole structure; and an upper coupled to the sole structure, wherein the upper comprises: a main portion comprising a top section, a bottom section, a toe portion, a midfoot portion, a heel portion, a lateral side, and a medial side, wherein the top section and the bottom section are separated by a gap; a securing mechanism adjustably coupled to the midfoot portion of the main portion; and a heel lock member having a first end, a second end, and an outermost surface that is coplanar with an outer surface of the top section, an outer surface of the bottom section, or both the outer surface of the top section and the outer surface of the bottom section, wherein the heel lock member is an elastic material and is disposed within the gap between the top section and the bottom section, inset within an outer surface of the main portion, and permanently stitched, glued, or thermally bonded to the top section and the bottom section, and wherein the heel lock member is adjustably coupled to the securing mechanism, wherein the heel lock member passes around the heel portion of the article of footwear, the first end of the heel lock member attaches to a lateral midfoot region, and the second end of the heel lock member attaches a medial midfoot edge region, and a first sole attachment member and a second sole attachment member attach to the sole structure at a bite line, and wherein the heel lock member is configured to tighten the upper of the article of footwear around a wearer's foot.

6. The article of footwear of claim 5, wherein the heel lock member is further attached to the upper by one or more anchoring elements.

7. The article of footwear of claim 6, wherein the one or more anchoring elements are a material of higher stiffness than the heel lock member.

8. The article of footwear of claim 5, wherein the heel lock member has one or more holes at each end to allow a portion of the securing mechanism to pass through.

9. The article of footwear of claim 5, wherein the article of footwear further comprises a liner disposed along an interior side of the upper.

10. The article of footwear of claim 9, wherein the liner is configured to: cushion the wearer's foot, waterproof a foot-receiving cavity, wick moisture from the foot-receiving cavity, or any combination thereof.

11. A securing mechanism for an article of footwear, comprising: a forefoot portion; and a heel lock element fixedly attached to a top section and a bottom section of a corresponding upper of an article of footwear and for adjusting a heel segment of the corresponding upper when tensioned, wherein the heel lock element is an elastic material and includes: a first end configured to attach to a lateral side of the corresponding upper and disposed within a first portion of a recess, wherein the first portion of the recess extends between a first edge of the top section and a first edge of the bottom section of an article of footwear; a second end configured to attach to a medial side of the corresponding upper and disposed within a second portion of the recess, wherein the second portion of the recess extends between a second edge of the top section and a second edge of the bottom section of an article of footwear; and a heel band configured to pass around a heel region of the corresponding upper and to extend to the medial side of the corresponding upper, wherein an outermost surface of the heel lock element is coplanar with an outer surface of the top section, an outer surface of the bottom section, or both the outer surface of the top section and the outer surface of the bottom section.

12. The securing mechanism of claim 11, wherein the heel lock element comprises a stiffness greater than that of the corresponding upper.

13. The securing mechanism of claim 11, wherein the heel lock element further comprises one or more anchoring elements.

14. The securing mechanism of claim 13, wherein the one or more anchoring elements have a higher stiffness than the heel band.

15. The article of footwear of claim 1, wherein the heel lock element is permanently stitched, glued, or thermally bonded to the top section of the upper and the bottom section of the upper along some or all of the length of the heel lock element to form a single piece.

16. The article of footwear of claim 1, wherein the gap has a first width and the heel lock element has a second width, wherein the first width equals the second width.

* * * * *